US010570568B2

(12) United States Patent
Yasui et al.

(10) Patent No.: US 10,570,568 B2
(45) Date of Patent: Feb. 25, 2020

(54) TISSUE PAPER

(71) Applicants: DAIO PAPER CORPORATION, Ehime (JP); TOHOKU UNIVERSITY, Miyagi (JP)

(72) Inventors: Shuta Yasui, Shizuoka (JP); Norimitsu Hirata, Shizuoka (JP); Hidenori Yorozu, Tokyo (JP); Kazuo Hokkirigawa, Miyagi (JP); Takeshi Yamaguchi, Miyagi (JP); Kei Shibata, Miyagi (JP); Wataru Tanabe, Miyagi (JP); Shohei Matsumura, Miyagi (JP)

(73) Assignees: DAIO PAPER CORPPORATION, Ehime (JP); TOHOKU UNIVERSITY, Miyagi (JP)

( * ) Notice: Subject to any disclaimer, the term of this patent is extended or adjusted under 35 U.S.C. 154(b) by 82 days.

(21) Appl. No.: 15/758,893

(22) PCT Filed: Aug. 4, 2016

(86) PCT No.: PCT/JP2016/072949
§ 371 (c)(1),
(2) Date: Mar. 9, 2018

(87) PCT Pub. No.: WO2017/047273
PCT Pub. Date: Mar. 23, 2017

(65) Prior Publication Data

US 2018/0258592 A1 Sep. 13, 2018

(30) Foreign Application Priority Data

Sep. 14, 2015 (JP) ..... 2015-180821

(51) Int. Cl.
*D21H 27/00* (2006.01)
*A47K 10/16* (2006.01)
*D21H 27/30* (2006.01)

(52) U.S. Cl.
CPC ..... *D21H 27/005* (2013.01); *A47K 10/16* (2013.01); *D21H 27/00* (2013.01); *D21H 27/30* (2013.01)

(58) Field of Classification Search
USPC ..... 162/123
See application file for complete search history.

(56) References Cited

U.S. PATENT DOCUMENTS 6,162,327 A * 12/2000 Batra ..... B32B 29/06 162/109
7,972,474 B2 * 7/2011 Underhill ..... D21F 11/14 162/111

FOREIGN PATENT DOCUMENTS

| | | | |
|---|---|---|---|
| JP | H07-109694 | A | 4/1995 |
| JP | 2005-124884 | A | 5/2005 |
| JP | 2008-206918 | A | 9/2008 |
| JP | 2008-255496 | A | 10/2008 |
| JP | 2009-039308 | A | 2/2009 |
| JP | 4450552 | B2 | 4/2010 |
| JP | 4658056 | B2 | 3/2011 |
| JP | 4875488 | B2 | 2/2012 |
| JP | 2013111161 | A | 6/2013 |
| JP | 2015-147049 | A | 8/2015 |
| WO | 2005/118954 | A1 | 12/2005 |
| WO | 2011/080939 | A1 | 7/2011 |

OTHER PUBLICATIONS

Nezamoleslami et al., JP 2005 124884, machine translation, May 2005.*
International Search Report dated Oct. 18, 2016 of corresponding International application No. PCT/JP2016/072949; 5 pgs.
Decision to Grant a Patent dated Aug. 18, 2017 of corresponding Japanese application No. 2015-180821; 6 pages including Machine-generated English-language translation.
European Search Report dated Sep. 10, 2018 of corresponding European application No. 16846146; 2 pages.

* cited by examiner

*Primary Examiner* — Mark Halpern
(74) *Attorney, Agent, or Firm* — Maier & Maier, PLLC

(57) ABSTRACT

An all-purpose type tissue paper. A two-ply tissue paper that does not have moisturizer applied thereon, that has a basis weight per ply of 10.0-16.0 g/m2, a paper thickness per two-ply of 120-200 μm, a softness of not more than 1.0, a dry tensile strength (T) in the MD direction of 240-300 cN/25 mm, and an average dynamic friction coefficient of 1.40-1.65.

1 Claim, 1 Drawing Sheet

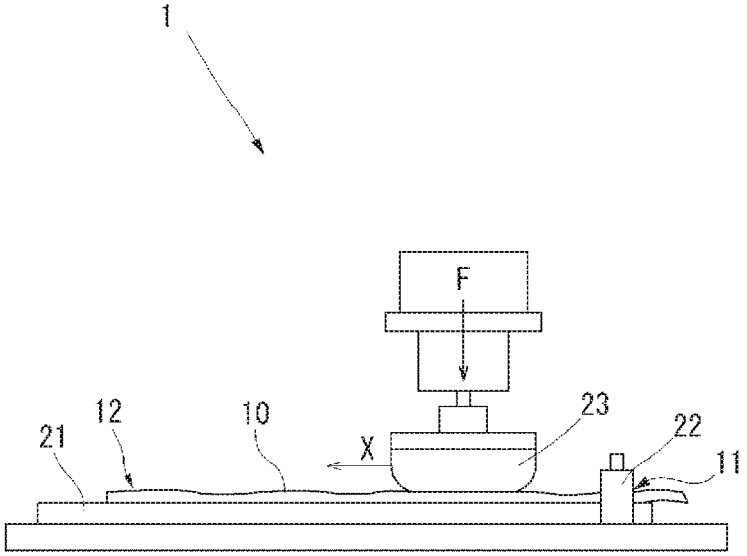
1
F
23
22
11
12
10
21
X

TISSUE PAPER

This application is a 371 of PCT/JP2016/072949 filed 4 Aug. 2016

TECHNICAL FIELD

The present invention relates to tissue paper, and particularly relates to all-purpose tissue having no moisturizer coated thereto and moisturizer uncoated tissue paper, which is also referred to as an all-purpose type.

BACKGROUND

Tissue paper is roughly classified into one having a moisturizer, such as a polyol, applied to base paper through external addition, and tissue paper having no moisturizer applied thereto.

The one having a moisturizer applied thereto is referred to as moisturizing tissue, chemical applied type tissue, or the like, and the water content thereof is increased through the hygroscopic effect of the moisturizer, so as to enhance the soft feeling and the smoothness.

On the other hand, the tissue paper having no moisturizer applied thereto is referred to as all-purpose tissue, an all-purpose type, or the like.

The chemical applied type tissue is specialized in nose blowing and facial purposes in consideration of the enhancement of the soft feeling due to the effect of the moisturizer, whereas the all-purpose type tissue paper is used not only for nose blowing and facial purposes but also for wiping dirt and dust, covering a wide range of purposes, and is particularly demanded to have a low price.

However, the all-purpose type tissue paper is also used for nose blowing and facial purposes with high frequency, and the soft feeling and the smoothness thereof are demanded by the consumers.

SUMMARY OF INVENTION

Accordingly, a major problem of the invention is to provide moisturizer-uncoated tissue paper also referred to as an all-purpose type having no moisturizer, such as a polyol, externally added thereto that has extremely high sensory evaluation values by the consumers, such as the soft feeling and the smoothness, has a small burden on the skin not to damage the skin surface in use thereof by rubbing the skin in nose blowing or wiping the skin, and also has a strength preventing the breakage thereof in nose blowing, and particularly the moisturizer-uncoated tissue paper that has a low price.

The measure for solving the problem is as follows.

Two-ply tissue paper having no moisturizer coated thereon, having:

a basis weight per one ply of from 10.0 to 16.0 g/m$^2$, a paper thickness per two plies of from 120 to 200 μm, a softness of 1.0 or less, a dry tensile strength (T) in MD of from 240 to 300 cN/25 mm, and an average dynamic friction coefficient of from 1.40 to 1.65.

Advantageous Effects of Invention

According to the invention, moisturizer-uncoated tissue paper also referred to as an all-purpose type is provided that has extremely high sensory evaluation values by the consumers, such as the soft feeling and the smoothness, has a small burden on the skin not to damage the skin surface in use thereof by rubbing the skin in nose blowing or wiping skin, and also has a strength preventing the breakage thereof in nose blowing.

BRIEF DESCRIPTION OF DRAWING

FIG. 1 is an illustration for describing a measurement method of an average dynamic friction coefficient in the invention.

DETAILED DESCRIPTION OF THE DRAWING

Embodiments of the invention will be described below.

The tissue paper according to the invention is moisturizer-uncoated tissue paper having no moisturizer externally added thereto by coating or the like, which is also referred to as all-purpose tissue, an all-purpose type, or the like.

Moisturizers that are not used as an external additive in the invention are those having hygroscopicity as a major effect, such as glycerin, diglycerin, propylene glycol, 1,3-butylene glycol, polyethylene glycol, sorbitol, glucose, xylitol, maltose, maltitol, mannitol, and trehalose.

The number of plies of the tissue paper is two, the paper thickness thereof per two plies is from 120 to 200 μm, and the basis weight thereof per one ply is from 10.0 to 16.0 g/m$^2$.

When the paper thickness is less than 120 μm, it is difficult to ensure a strength that is sufficient for preventing breakage in nose blowing, and when the paper thickness exceeds 200 μm, it is difficult to exhibit soft feeling.

When the basis weight is less than 10.0 g/m$^2$, it is difficult to ensure the sufficient strength. When the basis weight exceeds 16.0 g/m$^2$, on the other hand, it is difficult to exhibit soft feeling. The basis weight of from 10.0 to 16.0 g/m$^2$ is an important range also from the standpoint of ensuring cost as the all-purpose type in relation to raw material pulp. In other words, when the basis weight exceeds the range, it is difficult to provide such a price that ensures the appealing power as an all-purpose type product in relation to raw material cost.

The basis weight referred in the invention means a value that is measured based on JIS P8124 (1998), and the paper thickness herein means a value that is measured in such a manner that a test piece is sufficiently controlled for moisture content under the condition of JIS P8111 (1998), and measured for the paper thickness under the same condition with a dial thickness gauge (thickness measuring instrument), "Peacock Type G" (produced by Ozaki MFG Co., Ltd.).

The specific procedure for the measurement of the paper thickness is as follows. After confirming that dirt and dust are not present between a plunger and a measurement pedestal, the plunger is lowered onto the measurement pedestal, and the scale of the dial thickness gauge is moved to the zero point. Subsequently, the plunger is raised, a specimen is placed on a test pedestal, the plunger is slowly lowered, and the gauge is read. At this time, the plunger is only put thereon. A terminal of the plunger is set such that a circular flat surface having a diameter of 10 mm formed of metal perpendicularly contacts the paper surface, and the load in the measurement of the paper thickness is approximately 70 gf. The measurement is performed 10 times, and the resulting average value is used.

The tissue paper according to the invention has a softness of 1.0 or less. The softness is an index of the soft feeling, and when the softness is in the range, flexible and soft feeling can be particularly obtained in use.

The softness herein means a value that is measured based on the Handle-o-Meter method according to the method E of JIS L1096. Herein, the test piece has a size of 100 mm×100 mm, and the clearance is 5 mm. One ply is measured 5 times in each of the longitudinal direction and the transverse direction, and the average value of the 10 measurements in total is used. The softness has no unit, but may be expressed with a unit cN/100 mm in consideration of the size of the test piece.

The tissue paper according to the invention has a dry tensile strength (T) in MD (which may also be referred to as a longitudinal direction) per two plies of from 240 to 300 cN/25 mm. When the dry tensile strength (T) in MD (which may also be referred to as a longitudinal direction) per two plies is in the range, the strength is sufficient for use particularly in wiping dirt and dust as the all-purpose type. The dry tensile strength herein means a value that is measured based on the tensile test of JIS P8113 (1998).

The tissue paper according to the invention has an average dynamic friction coefficient of from 1.40 to 1.65. When the average dynamic friction coefficient is in the range, soft feeling and surface smoothness can be particularly obtained in use. Furthermore, even when the tissue paper is used for rubbing the skin in nose blowing or wiping the skin, the burden on the skin is small to reduce damage to the skin surface.

The average dynamic friction coefficient in the invention can be measured with a pin-on-plate friction tester 1. The pin-on-plate friction tester may be one capable of appropriately selecting the slipping velocity from a range of from 0.1 to 100.0 mm/s, the vertical load from a range of from 0 to 1 kgf, and the slipping distance from a range of from 1 to 200 mm.

The average dynamic friction coefficient in the invention may be measured in the following manner as shown in FIG. 1. Tissue paper 10 as a specimen having a sufficient size is placed on a horizontal plate 21 of the pin-on-plate friction tester 1, and one side edge 11 thereof is fixed with a jig 22 or the like. Thereafter, on the tissue paper 10, a contact probe 23 is horizontally moved while contacting therewith, from the fixed position in the direction toward the unfixed edge 12 (i.e., the X direction in the FIGURE), under conditions of a slipping velocity of 1.0 mm/s, a vertical load F of 50 gf, and a slipping distance of 5.0 mm, and the average value of the dynamic friction coefficients obtained herein is measured. The average dynamic friction coefficient means an average value of the friction coefficients within a slipping distance of from 4 to 5 mm of each of the specimens of the tissue paper.

The measurement conditions are an experimental laboratory temperature of 20° C. and an experimental laboratory humidity of 20% RH, and the lubricating condition is an unlubricated condition in the air. The measurement specimen is allowed to stand in a chamber at 25° C. and 20% RH for 24 hours, and then subjected to the test. In the measurement, the movement of the contact probe 23 is one way sliding, not reciprocal sliding. The contact probe 23 has a contact area equivalent to or larger than a human fingertip, is formed of a soft urethane material having a hardness equivalent to a human finger, and has plural grooves equivalent to a human fingerprint formed in the urethane material in the direction perpendicular to the movement direction. Specific examples of an apparatus for performing the measurement include Tribomaster type μv1000, produced by Trinity-Lab, Inc. In the apparatus, the "sensory contact probe" as an optional device available from the company may be used as a contact probe for the measurement.

The basis why the tissue paper according to the invention, for which the average dynamic friction coefficient measured in the aforementioned measurement method is employed, and which has the average dynamic friction coefficient, the softness, and the dry tensile strength in MD (which may also be referred to as a longitudinal direction) per two plies that satisfy the ranges of the invention, exhibits soft feeling and smoothness in use will be described. The present inventors have performed sensory evaluation test for numerous kinds of currently available tissue paper including commercial products, and also performed various measurements therefor relating to friction, which may influence the smoothness and the soft feeling, including the known physical values, such as the softness, the MMD value, and the tensile strength, and the average dynamic friction coefficient according to the invention. In the sensory evaluation test, various kinds of tissue paper as specimens are served to subjects in a random order for each subject, and the subjects each use the tissue paper in an unrestricted manner determined by the subject, such as nose blowing, touching with hand, and wiping. With the unrestricted use manner by the subjects, the "skin touch feeling" of each tissue paper as a specimen is ranked only by standards of "like" or "dislike", and the sensory evaluation value is a value obtained by dividing the sum of the points of each of the ranked specimens by the number of subjects. In the ordinary sensory evaluation, it is general that evaluation is performed for each of soft feeling, smoothness, liking, strength, and the like, and the sum of the results is designated as the evaluation value. In the sensory evaluation test herein, the first impression in the use of the tissue paper in the unrestricted manner is evaluated, so as to express significantly the sensation in use. The mutual relationship between the sensory evaluation value and the aforementioned property values and measurement values relating to friction is analyzed by simple linear regression analysis and multiple linear regression analysis, and it has been confirmed that the softness, the dry tensile strength in MD (which may also be referred to as a longitudinal direction) per two plies, and the average dynamic friction coefficient each have high mutual relationship to the sensory evaluation value while retaining the independency among them, and a certain regression expression is obtained between the sensory evaluation value and the average dynamic friction coefficient. According to the regression expression relating to the average dynamic friction coefficient, and based on the scheme to design tissue paper that has an average dynamic friction coefficient within the aforementioned range, which is not achieved by the ordinary all-purpose tissue paper, along with the softness and the dry tensile strength in MD (which may also be referred to as a longitudinal direction) per two plies, tissue paper that satisfies all the three property values has been completed as described later. Therefore, the tissue paper according to the invention has a basis weight and a paper thickness within the aforementioned range, which mean that the basis weight and the paper thickness are restricted to those of the all-purpose type, but satisfies the softness, the dry tensile strength (T) in MD (which may also be referred to as a longitudinal direction) per ply, and the average dynamic friction coefficient in the invention, and thereby has an extremely high sensory evaluation value, has a small burden on the skin not to damage the skin surface in actual use thereof for rubbing the skin in nose blowing or wiping the skin, and also has a strength preventing the breakage thereof in nose blowing and wiping dirt and dust, while the tissue paper is moisturizer-uncoated tissue paper having no moisturizer such as polyol externally added thereto, which is also referred to as an all-purpose type.

For producing the tissue paper according to the invention satisfying the softness, the dry tensile strength (T) in MD (which may also be referred to as a longitudinal direction) per two plies, and the average dynamic friction coefficient, while the tissue paper is moisturizer-uncoated tissue paper having no moisturizer such as polyol externally added thereto, which is also referred to as an all-purpose type, it suffices that the tissue paper is produced by using a combination of a particular softener compound, a particular wet paper strengthening agent, and a particular dry paper strengthening agent.

The softener compound includes a fatty acid ester compound and a fatty acid amide compound, the wet paper strengthening agent includes polyamide epichlorohydrin, and the dry paper strengthening agent includes at least one of polyacrylamide and cationic starch.

The fatty acid ester compound may be any of a cationic fatty acid ester compound and a nonionic fatty acid ester compound, and preferably contains both of them. The fatty acid ester compound is preferably a compound of an alcohol having 6 to 24 carbon atoms and a fatty acid having 7 to 25 carbon atoms. The alcohol may be any of a linear alcohol, an alcohol having a branched chain, a saturated alcohol, and an unsaturated alcohol. In particular, an alcohol having 10 to 22 carbon atoms is preferred, and lauryl alcohol, myristyl alcohol, cetyl alcohol, stearyl alcohol, behenyl alcohol, and oleyl alcohol are preferred. One kind thereof may be used solely, or two or more kinds thereof may be used in combination. The fatty acid having 7 to 25 carbon atoms may be any of a linear fatty acid, a fatty acid having a branched chain, a saturated fatty acid, and an unsaturated fatty acid. In particular, a fatty acid having 10 to 22 carbon atoms is preferred, and lauric acid, myristic acid, palmitic acid, stearic acid, behenic acid, and oleic acid are preferred. One kind thereof may be used solely, or two or more kinds thereof may be used in combination.

The fatty acid amide compound can be obtained through reaction of polyalkylenepolyamine and a carboxylic acid. The preferred polyalkylenepolyamine is a compound represented by the following formula (1) having at least three amino groups in the molecule:

$$H_2N—(R_1—NH—)_n—R_1—NH_2 \quad (1)$$

(wherein $R_1$ each independently represent an alkylene group having 1 to 4 carbon atoms, and n represents an integer of from 1 to 3). In the polyacrylamine, different groups of $R_1$ may be present in the molecule. Two or more kinds of the polyalkylenepolyamine may be used. The preferred $R_1$ is an ethylene group. The carboxylic acid is preferably a carboxylic acid having 10 to 24 carbon atoms, and may be any of a saturated carboxylic acid and an unsaturated carboxylic acid. The carboxylic acid may also be any of a linear carboxylic acid and a carboxylic acid having a branched chain. Among these, a carboxylic acid having 12 to 22 carbon atoms is preferred, and a carboxylic acid having 14 to 18 carbon atoms is particularly preferred.

For achieving the average dynamic friction coefficient, the softness, and the dry tensile strength (T) in MD, the tissue paper according to the invention may be produced to satisfy any of or a combination of the following requirements (1) to (3), in addition to the use of the basis weight, the paper thickness, the particular softener compound, the particular wet paper strengthening agent, and the particular dry paper strengthening agent.

Specifically, (1) the content of the fatty acid ester compound is from 0.01 to 0.30 part by mass per 100 parts by mass of the pulp fibers, the content of the fatty acid amide compound is from 0.01 to 0.20 part by mass per 100 parts by mass of the pulp fibers, the content of the wet paper strengthening agent is from 0.1 to 1.0 part by mass per 100 parts by mass of the pulp fibers, and the content of the dry paper strengthening agent is from 0.01 to 0.20 part by mass per 100 parts by mass of the pulp fibers.

(2) The ratio of the content of the softener compound to the total content of the wet paper strengthening agent and the dry paper strengthening agent ((softener compound)/(wet paper strengthening agent+dry paper strengthening agent)) is 0.30 or less.

(3) The ratio of the content of the fatty acid ester compound to the total content of the fatty acid amide compound, the polyamide epichlorohydrin, and the polyacrylamide ((fatty acid ester compound)/(fatty acid amide compound+polyamide epichlorohydrin+polyacrylamide)) is 0.20 or less.

The control of the average dynamic friction coefficient, the softness, and the dry tensile strength (T) in MD to the ranges in the tissue paper according to the invention can be easily achieved by using the softener compound, the wet paper strengthening agent, and the dry paper strengthening agent described above with the basis weight and the paper thickness described above, and further satisfying the requirements (1) to (3), and the further control thereof can be achieved by the crepe rate and the kind and the compositional ratio of the pulp fibers. The crepe rate is preferably controlled to be in a range of from 13 to 20%. When the crepe rate is less than 13%, sufficient elongation and soft feeling may be difficult to achieve in relation to the softener compound, the wet paper strengthening agent, the dry paper strengthening agent, and the dry tensile strength (T), and when the crepe rate exceeds 20%, smoothness may be difficult to exhibit. The pulp fibers preferably contain a mixture of NBKP (needle bleached kraft pulp) and LBKP (leaf bleached kraft pulp). The pulp fibers are more preferably formed only of NBKP and LBKP, and the mixing ratio is preferably NBKP/LBKP=20/80 to 80/20, and particularly preferably NBKP/LBKP=30/70 to 60/40. The paper strength, the softness, and the like can be controlled by the mixing ratio of NBKP and LBKP.

As for the requirement (1), the soft feeling, the smoothness, and the strength can be sufficiently enhanced to provide an extremely high sensory evaluation value by the consumers, by using a combination of the fatty acid ester compound and the fatty acid amide compound as the softener compound, using a combination of polyamide epichlorohydrin as the wet paper strengthening agent, and at least one of the polyacrylamide and the cationic starch as the dry paper strengthening agent, and controlling the contents thereof to the aforementioned ranges.

Accordingly, the tissue paper according to the invention may use the particular softener compound, the particular wet paper strengthening agent, and the particular dry paper strengthening agent, which are limited as above, and may have the prescribed contents thereof with respect to the pulp fibers, and thereby the tissue paper provides the synergistic effect of the agents without impairing the effects of the respective agents although the tissue paper is an all-purpose type with no chemical solution coated. The soft feeling is exhibited by decreasing the stiffness with the softener compound, and also the paper strength is enhanced while preventing the decrease of the paper strength, which is an adverse effect of the softener compound, without impairing the effect of the softener compound, thereby enhancing the soft feeling and the smoothness and retaining the paper strength. The softener compound, the wet paper strengthening agent, and the dry paper strengthening agent may be used as internal additives according to the ordinary process of the production method of the all-purpose type tissue paper. Specifically, the tissue paper may be produced through paper manufacturing with a paper manufacturing raw material (which may also be referred to as a paper raw material) containing a raw material pulp as the pulp fibers having the softener compound, the wet paper strengthening agent, and the dry paper strengthening agent added thereto.

As for the requirement (2), the tissue paper according to the invention may have soft feeling, smoothness, and strength that are sufficiently enhanced, by using a combination of the fatty acid ester compound and the fatty acid amide compound as the softener compound, using a combination of polyamide epichlorohydrin as the wet paper strengthening agent, and at least one of the polyacrylamide and the cationic starch as the dry paper strengthening agent, and controlling the ratio of the total content of the softener compound to the total content of the wet paper strengthening agent and the dry paper strengthening agent to 0.30 or less. Accordingly, by achieving the aforementioned range, the soft feeling is exhibited by decreasing the stiffness with the softener compound, and also the paper strength is enhanced while preventing the decrease of the paper strength, which is an adverse effect of the softener compound, without impairing the effect of the softener compound, thereby enhancing the soft feeling and the smoothness, retaining the paper strength, and providing an extremely high sensory evaluation value by the consumers. When the ratio of the softener compound is too large and exceeds 0.30, the decrease of the paper strength due to the softener compound may not be prevented, and such a measure may be necessarily used that the pulp fibers are beaten to enhance the paper strength, which leads to deterioration of the smoothness due to damages of the pulp fibers, expecting no improvement in soft feeling. When the ratio of the wet paper strengthening agent and the dry paper strengthening agent is too small, and the ratio exceeds 0.30, it may be difficult to exhibit the paper strength.

As for the requirement (3), the tissue paper according to the invention may have soft feeling, smoothness, and strength that are sufficiently enhanced to provide an extremely high sensory evaluation value by the consumers, by controlling the ratio of the content of the fatty acid ester compound to the total content of the fatty acid amide compound, the polyamide epichlorohydrin, and the polyacrylamide ((fatty acid ester compound)/(fatty acid amide compound+polyamide epichlorohydrin+polyacrylamide)) to 0.20 or less.

The fatty acid ester compound has an effect of improving the wettability and the bulkiness (fluffiness) of the surface of the tissue paper, the fatty acid amide compound, the polyamide epichlorohydrin, the polyacrylamide, and the cationic starch have an effect of coating the fiber surface, and the use of the softener compound, the wet paper strengthening agent, and the dry paper strengthening agent enhances not only the soft feeling but also the smoothness on the surface. In particular, by using them as internal additives according to the ordinary process of the production method of the all-purpose type tissue paper, the fatty acid ester compound is well adapted to the pulp fibers, and the effect of coating the fiber with the fatty acid amide compound, the polyamide epichlorohydrin, the polyacrylamide, and the cationic starch is facilitated, when drying the wet paper with a Yankee dryer, so as to enhance the smoothness. However, in the case where the requirement (3) is not satisfied for the ranges of the basis weight and the paper thickness, the smoothness is less likely to be exhibited in some cases even though the particular softener compound, the particular wet paper strengthening agent, and the particular dry paper strengthening agent are used. Specifically, when the basis weight and the paper thickness are outside the ranges, the density is decreased, and the roughness of the pulp fibers is felt even though the particular softener compound, the particular wet paper strengthening agent, and the particular dry paper strengthening agent according to the invention are used, and it may be difficult to feel the smoothness in some cases.

In the requirements (2) and (3) in particular, it is not restricted that the softener compound, the wet paper strengthening agent, and the dry paper strengthening agent are contained in the aforementioned mass ratios with respect to the pulp fibers, but when they satisfy the requirement (1), significant effects may be obtained particularly in the smoothness, the soft feeling, the enhancement effect of the paper strength, and the sensory evaluation value by the consumers. The contents in the requirements (2) and (3) are based on the content expressed by part by mass with respect to the pulp fibers.

Examples

Examples 1 to 3 of the tissue paper according to the invention and Comparative Examples 1 to 9 were measured for the property values including the basis weight, the paper thickness, the wet and dry tensile strength in the longitudinal and transverse directions, the elongation, the softness, the elongation, the MMD value, and the average dynamic friction coefficient, and were also subjected to the sensory evaluation.

Comparative Examples 1 to 3 are products produced herein, and Comparative Examples 4 to 9 are commercially available products. Comparative Examples 4 and 5 have no chemical solution coated thereon, but have a relatively large basis weight and a high price. In all the examples, no moisturizer is coated. The compositions and the property values in the examples are shown in Table 1 below.

The MMD value is measured in the following manner. A contact surface of a friction probe is made in contact with the surface of the measurement specimen, to which a tension of 20 g/cm is applied in a prescribed direction, under a contact pressure of 25 g, and while contacting, is moved in the direction that is substantially the same as the direction, to which the tension was applied, by 2 cm at a velocity of 0.1 cm/s, and the friction coefficient in the movement is measured with a friction tester, KES-SE (produced by Kato Tech Co., Ltd.). The value obtained by dividing the friction coefficient by the friction distance (i.e., the movement distance of 2 cm) is designated as the MMD value. The friction probe is formed of 20 pieces of piano wire P each having a diameter of 0.5 mm and made adjacent to each other to have a contact surface formed to have a length and a width, both of which are 10 mm. The contact surface has a unit bulge portion having a tip formed of 20 pieces of piano wire P (curvature radius: 0.25 mm).

The elongation is in accordance with JIS P8113 (1998).

TABLE 1

| | | | Example 1 | Example 2 | Example 3 | Comparative Example 1 | Comparative Example 2 | Comparative Example 3 |
|---|---|---|---|---|---|---|---|---|
| Pulp mixture | NBKP | % | 28.7 | 28.7 | 30 | 30 | 30 | 30 |
| | LBKP | % | 71.3 | 71.3 | 70 | 70 | 70 | 70 |
| Crepe rate | | % | 16 | 18 | 15.3 | 15 | 13.5 | 13.5 |
| (1) Softener compound (fatty acid ester compound) | | part by mass | 0.10 | 0.10 | 0.05 | 0.20 | 0.70 | 0.20 |
| (2) Softener compound (fatty acid amide compound) | | part by mass | 0.05 | 0.02 | 0.08 | — | 0.15 | 0.12 |
| (3) Wet paper strengthening agent (polyacrylamide epichlorohydrin) | | part by mass | 0.50 | 0.50 | 0.50 | 0.50 | 0.50 | 0.50 |
| (4) Dry paper strengthening agent (polyacrylamide) | | part by mass | 0.06 | 0.06 | — | 0.06 | 0.06 | 0.06 |
| (5) Dry paper strengthening agent (cationic starch) | | part by mass | — | — | 0.06 | — | — | — |
| (A) Total of softener compounds | | part by mass | 0.15 | 0.12 | 0.13 | 0.20 | 0.85 | 0.32 |
| (B) Total of wet paper strengthening agent and dry paper strengthening agent | | part by mass | 0.56 | 0.56 | 0.56 | 0.56 | 0.56 | 0.56 |
| (A)/(B) | | — | 0.27 | 0.21 | 0.23 | 0.36 | 1.52 | 0.57 |
| Total of (2) + (3) + (4) and/or (5) | | part by mass | 0.61 | 0.58 | 0.58 | 0.56 | 0.71 | 0.68 |
| (1)/(2) + (3) + (4) and/or (5) | | — | 0.16 | 0.17 | 0.09 | 0.36 | 0.99 | 0.29 |
| Basis weight | | $g/m^2$ | 12.3 | 12.0 | 12.2 | 12.2 | 12.4 | 12.6 |
| Paper thickness (two plies) | | μm | 138 | 123 | 135 | 125 | 131 | 132 |
| Dry tensile strength in MD | | cN/25 mm | 256 | 242 | 251 | 270 | 339 | 271 |
| Dry tensile strength in CD | | cN/25 mm | 130 | 96 | 134 | 120 | 159 | 144 |
| Wet tensile strength in MD | | cN/25 mm | 83 | 87 | 60 | 91.4 | 109 | 88 |
| Wet tensile strength in CD | | cN/25 mm | 41 | 38 | 39 | 43.8 | 54 | 50 |
| Elongation | | % | 12.5 | 13.3 | 11.1 | 10.7 | 10.7 | 7.4 |
| Softness | | cN/100 mm | 0.90 | 0.72 | 0.98 | 1.10 | 0.96 | 1.10 |
| MMD value | | — | 6.8 | 6.2 | 6.0 | 6.5 | 7.2 | 7.2 |
| Average dynamic friction coefficient | | — | 1.58 | 1.62 | 1.51 | 1.59 | 1.47 | 1.46 |
| Sensory evaluation value | | | 5.4 | 5.4 | 5.6 | 4.5 | 4.6 | 4.2 |

| | | | Comparative Example 4 | Comparative Example 5 | Comparative Example 6 | Comparative Example 7 | Comparative Example 8 | Comparative Example 9 |
|---|---|---|---|---|---|---|---|---|
| Pulp mixture | NBKP | % | 30 | — | — | — | — | — |
| | LBKP | % | 70 | — | — | — | — | — |
| Crepe rate | | % | — | — | — | — | — | — |
| (1) Softener compound (fatty acid ester compound) | | part by mass | — | — | — | — | — | — |
| (2) Softener compound (fatty acid amide compound) | | part by mass | — | — | — | — | — | — |
| (3) Wet paper strengthening agent (polyacrylamide epichlorohydrin) | | part by mass | 0.50 | — | — | — | — | — |
| (4) Dry paper strengthening agent (polyacrylamide) | | part by mass | 0.06 | — | — | — | — | — |
| (5) Dry paper strengthening agent (cationic starch) | | part by mass | — | — | — | — | — | — |
| (A) Total of softener compounds | | part by mass | — | — | — | — | — | — |
| (B) Total of wet paper strengthening agent and dry paper strengthening agent | | part by mass | 0.56 | — | — | — | — | — |
| (A)/(B) | | — | — | — | — | — | — | — |
| Total of (2) + (3) + (4) and/or (5) | | part by mass | 0.56 | — | — | — | — | — |
| (1)/(2) + (3) + (4) and/or (5) | | — | | | | | | |
| Basis weight | | $g/m^2$ | 13.2 | 15.5 | 14.2 | 12.1 | 10.9 | 10.8 |
| Paper thickness (two plies) | | μm | 142 | 190 | 129 | 129 | 119 | 101 |
| Dry tensile strength in MD | | cN/25 mm | 348 | 285 | 347 | 354 | 367 | 524 |
| Dry tensile strength in CD | | cN/25 mm | 90 | 102 | 142 | 152 | 133 | 161 |
| Wet tensile strength in MD | | cN/25 mm | — | — | — | — | — | — |
| Wet tensile strength in CD | | cN/25 mm | 29 | 35 | 36 | 41 | 29 | 37 |
| Elongation | | % | — | — | — | — | — | — |
| Softness | | cN/100 mm | 1.14 | 1.15 | 1.24 | 0.88 | 0.96 | 1.06 |
| MMD value | | — | 7.4 | 5.9 | 6.9 | 8.4 | 7.9 | 7.1 |
| Average dynamic friction coefficient | | — | 1.46 | 1.45 | 1.73 | 1.65 | 1.76 | 1.73 |
| Sensory evaluation value | | | 4.0 | 5.2 | 4.5 | 4.8 | 3.0 | 3.5 |

As seen in Table 1, Examples 1 to 3 according to the invention among the examples result in high sensory evaluation values.

In Comparative Examples 6 and 7, on the other hand, particularly the average dynamic friction coefficient and the dry tensile strength in MD per two plies are larger than the ranges of the invention, and thus the sensory evaluation values are extremely low. In Comparative Examples 1 to 3, the average dynamic friction coefficient is in the range of the invention, but any one of the softness and the dry tensile strength in MD per two plies is outside the range of the invention, and thus one in which only the average dynamic friction coefficient is within the range of the invention also results in a low sensory evaluation value. In Comparative Example 4, both the softness and the dry tensile strength in MD per two plies are outside the ranges of the invention, and thus the sensory evaluation value is low. In Comparative Example 5, which has a large basis weight and has a relatively high price as non-moisturized tissue, the softness is outside the range of the invention, and thus the sensory evaluation value is inferior to those of Examples according to the invention.

In view of the above, an excellent sensory evaluation value is obtained in the case where all the three property values, i.e., the average dynamic friction coefficient, the dry tensile strength in MD per two plies, and the softness, are in the ranges of the invention. Therefore, the invention provides moisturizer-uncoated tissue paper also referred to as an all-purpose type that exhibits enhanced soft feeling, smoothness, and strength, and thus has a small burden on the skin not to damage the skin surface in use thereof for rubbing the skin in nose blowing or wiping the skin, and also a strength preventing the breakage thereof in nose blowing.

The invention claimed is:

1. A two-ply tissue paper having no moisturizer coated thereon, comprising:

a basis weight per one ply of from 10.0 to 16.0 g/m$^2$;

a paper thickness per two plies of from 120 to 200 μm;

a softness of 1.0 or less;

a dry tensile strength (T) in MD of from 240 to 300 cN/25 mm; and an average dynamic friction coefficient of from 1.40 to 1.65, wherein the tissue paper is produced without a moisturizer coating, and wherein the tissue paper is produced by using a combination of a softener compound, a wet paper strengthening agent and a dry paper strengthening agent.

* * * * *